United States Patent [19]

Lewis et al.

[11] 4,302,639

[45] Nov. 24, 1981

[54] TIMER DEVICE, ASSEMBLY, AND METHOD OF OPERATING

[75] Inventors: Merle J. Lewis, Morrison; Benito F. Marruffo, Rock Falls, both of Ill.

[73] Assignee: General Electric Company, Fort Wayne, Ind.

[21] Appl. No.: 77,015

[22] Filed: Sep. 19, 1979

[51] Int. Cl.[3] ..... H01H 7/08

[52] U.S. Cl. ..... 200/38 R; 74/568 T; 200/38 A; 200/38 BA; 200/291

[58] Field of Search ..... 200/38 A, 38 F, 38 FA, 200/38 R, 291, 38 BA; 74/568 T

[56] References Cited

U.S. PATENT DOCUMENTS

| | | | |
|---|---|---|---|
| 2,673,901 | 3/1954 | Kountz | 200/38 A |
| 3,180,157 | 4/1965 | Harris | 200/38 X |
| 3,234,805 | 2/1966 | Slouneger | 200/38 C |
| 3,839,925 | 10/1974 | Flicken et al. | 74/568 T |
| 3,853,015 | 12/1974 | Bertozzi et al. | 74/568 T |
| 4,123,915 | 11/1978 | Stoor | 62/234 |

*Primary Examiner*—J. V. Truhe
*Assistant Examiner*—Morris Ginsburg
*Attorney, Agent, or Firm*—Joseph E. Papin

[57] ABSTRACT

A timer device has a pair of switches, a pair of cam means adapted for rotation so as to respectively actuate the switches in a first preselected sequence, and means for driving the cam means to effect the respective rotation thereof. Means for driven association with the driving means so as to be rotatable with the cam means includes means rotatably adjustable from one operating position of at least a pair of operating positions toward another thereof for interrupting the actuation of one of the switches by the one cam means in the first preselected sequence with the actuation of the other of the switches by the other of the cam means and for permitting the actuation of the one switch by the one cam means in another preselected sequence with the actuation of the other switch by the other cam means.

An assembly for use in a timer device and a method of operating a timer device are also disclosed.

20 Claims, 8 Drawing Figures

TIMER DEVICE, ASSEMBLY, AND METHOD OF OPERATING

FIELD OF THE INVENTION

This invention relates in general to mechanisms utilized in the timed control of associated mechanisms and in particular to a timer device, a method of operating a timer device, and an assembly for use in a timer device.

BACKGROUND OF THE INVENTION

In the past, various different types of timer devices, such as defrost timers or the like for instance, have been utilized in various different apparatus or domestic appliances, such as refrigerators, freezers, heat pumps and air conditioners or the like, to controllably cycle a defrost heater thereof. The defrost heater is, of course, energized on a timed or periodic basis for automatically removing or melting frost or ice which may form on evaporators or other heat absorbing elements of the above discussed apparatus or domestic appliances and which may impair the operating efficiency thereof. In many of these past timer devices, a timer or synchronous motor was utilized to rotatably drive a cam which actuated a switch on a timed basis to controllably energize and deenergize the defrost heater, such as a heating coil or the like, connected in circuit relation with such switch.

Due to changing weather, atmospheric or climate conditions, the formation of frost on the evaporators of the aforementioned apparatus is, of course, at different rates, and it may not be necessary to defrost such apparatus, i.e., energize the heating coil thereof, as often when the frost is formed at a slower rate. Thus, it may be advantageous to delay or extend the defrost time interval or time period between successive energizations of the defrost heating coil by the defrost timer operably associated therewith, and such extension of the defrost time interval also serves to conserve energy which is advantageous in the light of the recent energy crisis.

One of the past defrost timers included a pair of alternate cams for actuating a switch thereof to controllably energize an associated defrost heating coil. However, in order to increase the periods between the energization of the defrost heating coil, it was necessary to physically reassemble one of the alternate cams in the switch operating place of the other alternate cam. Thus, at least one disadvantageous or undesirable feature of the aforementioned one past defrost timer is believed to be the necessity to interchange the alternate cams in order to increase the defrost time interval between defrost cycles. Of course, in order to effect the interchange of the alternate cams, as discussed above, it may have also been necessary to deenergize the apparatus and/or at least partially dismantle the defrost timer thereof which are also believed to be ancilliary disadvantageous features.

In another of the past defrost timers, a pair of cams were arranged generally in side-by-side relation, and the cam pair each had different peripheral configurations, i.e. rises and falls, arranged at least in part in overlaying relation to effect the actuation of a following switch which, in turn, controllably energized and deenergized an associated defrost heating coil. At least one of the disadvantageous or undesirable features of the aforementioned another past defrost timer is believed to be that it was necessary to operate or rotatably drive the cam pair conjointly at the same speed due to the overlaying relation of the cam pair. Another disadvantageous feature of the another past defrost timer is believed to be that the speed thereof was dictated by the cam cycles and necessarily was operated at the slowest speed, i.e. of the two cam cycles. Furthermore, since the operation of the another past defrost timer is believed to be at a relatively slow speed, a snap-acting switch was utilized in following relation with the cam pair which may have effected critical switch adjustments.

SUMMARY OF THE INVENTION

Among the several objects of the present invention may be noted the provision of an improved timing device, an improved assembly for a timing device, and an improved method of operating a timing device which overcome the above discussed disadvantageous or undesirable features, as well as others, with respect to the prior art; the provision of such improved timing device, assembly and method which permit the selection of different defrost time intervals; the provision of such improved timing device, assembly and method in which at least a pair of switch actuating cams are rotatably driven at different preselected speeds to effect the different defrost time intervals; and the provision of such improved timing device, assembly and method in which the component parts utilized are simplistic in design, easily assembled and economically manufactured. These as well as other objects or advantageous features of the present invention will be in part apparent and in part pointed out hereinafter.

In general a timer device in one form of the invention has a switch, a rotatable cam means for actuating the switch in a preselected sequence, and means for driving the cam means at a preselected speed. Gear means for driven association at a preselected different speed with the driving means includes means adjustable between at least a pair of operating positions and rotatable in at least one of the operating positions with respect to the cam means for interrupting the actuation of the switch in the preselected sequence and for effecting the actuation of the switch in another different preselected sequence.

Also in general and in one form of the invention, an assembly for use in a timer device has a pair of means respectively adapted for driven rotation and with one of the driven rotation means having at least one switch means operation configuration thereon. Means is mounted on one of the one driven rotation means and the other of the driven rotation means so as to be conjointly rotatable therewith and adjustably movable between a plurality of positions in releasable engagement with the other of the one driven rotation means and the other driven rotation means for transmitting the rotation thereof to the one of the one driven rotation means and the other driven rotation means. The transmitting means is adjustably movable in response to a manual rotative force applied to the one rotation means from one of its adjusted positions toward another thereof so as to predeterminately relocate the at least one switch means operation configuration with respect to the other driven rotation means.

Further in general, a method in one form of the invention is provided for operating a timer device having at least one switch means adapted for operation between at least a pair of switching modes thereof and at least one cam means for actuating the at least one switch means between the at least switching mode pair thereof. This method includes the steps of: rotating the at least one cam means at a preselected speed so as to effect the actuation of the at least one switch means between the at least switching mode pair thereof in a preselected sequence; and, adjusting with respect to the at least one cam means and from one operating position of at least a pair of operating positions toward another operating position thereof a means for interrupting the actuation of the at least one switch means by the at least one cam means in the preselected sequence and for permitting the actuation of the at least one switch means by the at least one cam means in another preselected sequence different than the first named preselected sequence and rotating the interrupting and permitting means at another preselected speed different than the first named preselected speed of the at least one cam means.

BRIEF DESCRIPTION OF THE DRAWINGS

Corresponding reference characters indicate corresponding parts throughout the several views of the drawings.

The exemplifications set out herein illustrate the preferred embodiment of the invention in one form thereof, and such exemplifications are not to be construed as limiting in any manner the scope of the invention.

DETAILED DESCRIPTION OF THE PREFERRED EMBODIMENT

Figure 1:
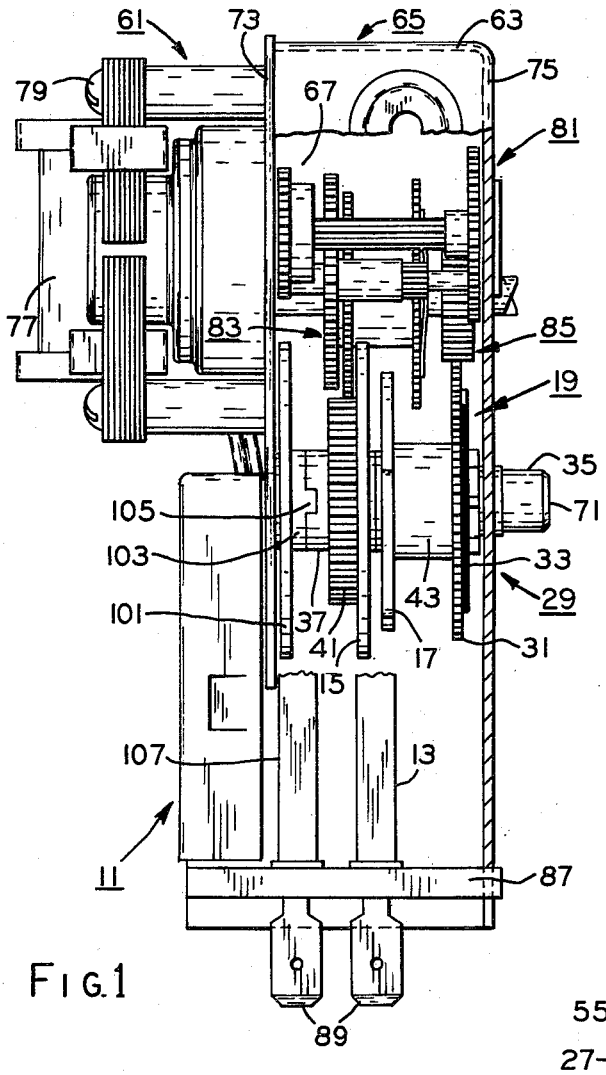
FIG. 1 is a top elevational view of a timer device in one form of the invention with the casing thereof partially broken away to clearly show the component parts thereof and to illustrate principles which may be utilized in practicing a method of operating a timer device also in one form of the invention.
Figure 4:
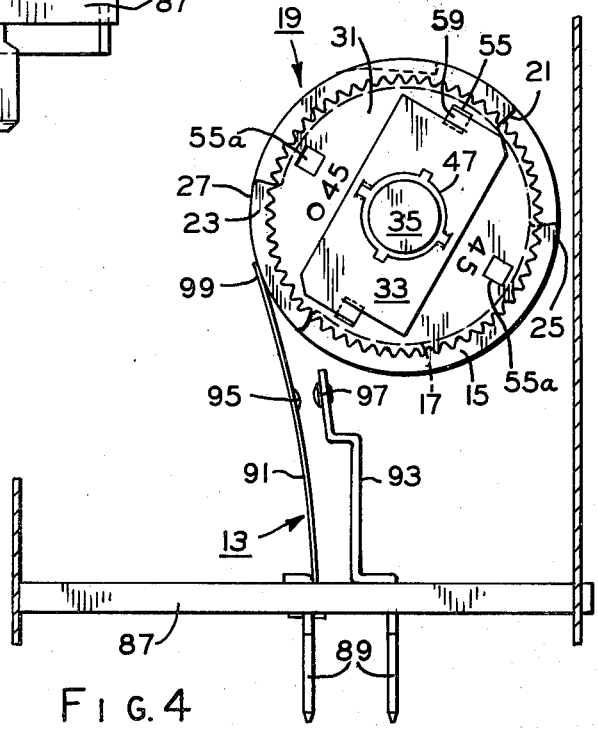
FIGS. 3 and 4 are sectional views taken from FIG. 1, respectively.
Figure 3:
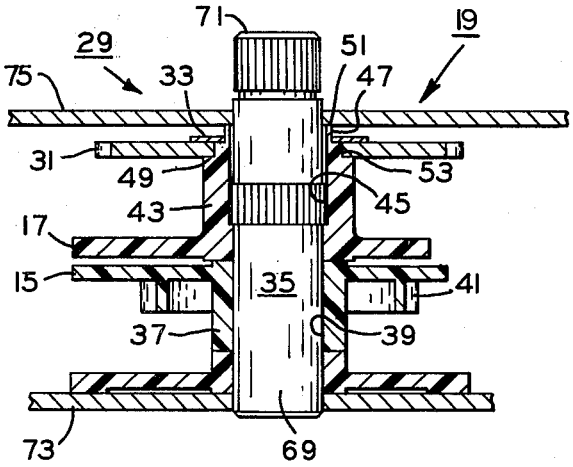
Figure 7:
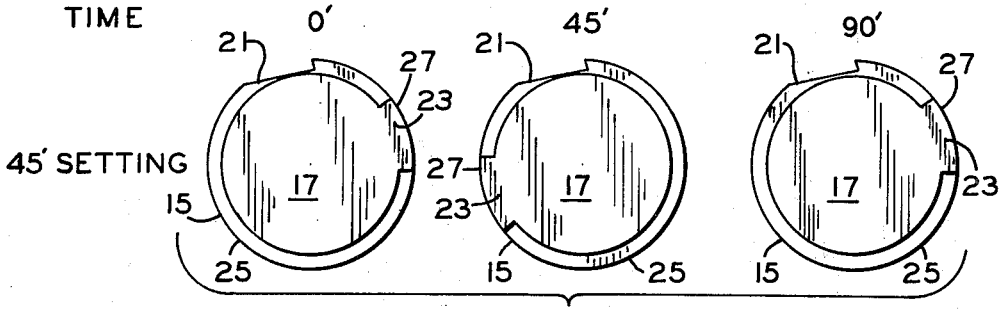
FIGS. 7 and 8 are schematic views illustrating the relative positions of a pair of cam means in the timer device of FIG. 1 at different defrost interval settings thereof, respectively.
Figure 8:
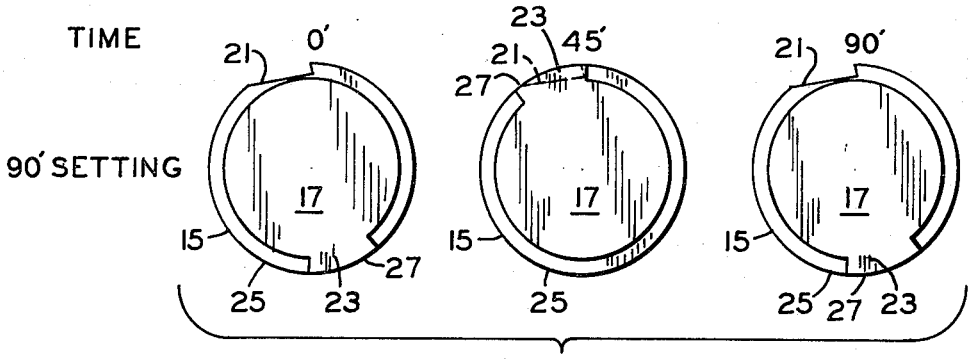

Referring now to the drawings in general, there is illustrated in one form of the invention a method of operating a timer device, such as for instance a defrost timer 11, having at least one switch means or switch 13 adapted for operation between at least a pair of switching modes and also having at least one cam means or cam 15 for actuating the switch between the at least switching mode pair thereof (FIGS. 1 and 4). In this method, cam 15 is rotated so as to effect the actuation of switch 13 between the switching mode pair thereof in a preselected sequence. A means, such as another cam 17 and an adjusting mechanism 19 associated therewith, is adjusted with respect to cam 15 from one of at least a pair of operating or adjusted positions toward another thereof for interrupting the actuation of switch 13 in the preselected sequence and also for effecting the actuation of the switch in another preselected sequence different than the first named preselected sequence (FIGS. 7 and 8). Actuation interrupting and effecting means, i.e. cam 17 and adjusting mechanism 19, and cam 15 are rotated at different preselected speeds (FIGS. 1 and 3).

More particularly and with specific reference to FIGS. 4, 7 and 8, cams 15, 17 are provided with generally complementary or inverted configurations, such as a switch operating rise 23 and a switch operating fall 21 for instance, in peripheral or camming surfaces 25, 27 of the cams, respectively. In the forty-five minute setting or operating mode of timer 11, as illustrated schematically in FIG. 7, cam 15 is rotated at its preselected speed into the positions shown therefor at the time intervals or periods indicated at zero, forty-five and ninety minutes so that fall 21 of cam 15 effects the actuation or operation of switch 13 in following engagement with camming surface 25, as shown in FIG. 4 and as discussed in detail hereinafter. Of course, the arcuate extent of fall 21 in camming surface 25 and the rotational speed of cam 15 determines the time period or interval that switch 13 is actuated from one of its switching or conductivity modes to another thereof during each rotation of cam 15. Thus, when cam 15 is so rotationally positioned to effect the actuation of switch 13 in its preselected sequence during the forty-five minute operating mode of timer 11, it may be noted that cam 17 is adjustably disposed or otherwise positioned in one of a pair of operating or adjusted rotated positions with respect to cam 15 as cam 17 is rotated at the aforementioned preselected speed different than that of cam 15; therefore, rise 23 of cam 17 is never located or rotated into a position in overlaying or blocking relation with fall 21 of cam 15 when it is engaged with switch 13 to effect the actuation thereof. In other words, due to the different preselected speeds of cams 15, 17 and the adjusted position of cam 17 with respect to cam 15, rise 23 in cam 17 never obviates or interrupts the preselected sequence of the actuation of switch 13 by fall 21 in cam 15 during the aforementioned forty-five minute operating mode of defrost timer 11.

In order to effect the transition of timer 11 from its forty-five minute setting to the ninety minute setting thereof, as illustrated schematically in FIG. 8, cam 17 is manually or adjustably rotated to its other adjusted position with respect to cam 15. When cam 17 is so moved or rotated to its other adjusted position, it may be noted that rise 23 thereof is located or rotated generally into overlaying relation with fall 21 of cam 15 at the forty-five minute interval so that cam surface 27 on rise 23 of cam 17 engages switch 13 thereby to block or obviate the actuation of the switch by fall 21 in cam 15. In this manner, it may be noted that the coaction of cams 15, 17 with switch 13, as discussed above, effects the actuation thereof in another preselected sequence during the ninety minute operating mode of timer 11 which is different than the preselected sequence of switch actuation during the forty-five minute operating mode of the timer, as previously mentioned. It is, of course, to be understood that the configurations 21, 23 of cams 15, 17 and the interval settings of timer 11 are illustrated herein merely for purposes of disclosure, and it is contemplated that other cams having other configurations and that different interval settings may be utilized in other timers within the scope of the invention so as to meet the objects thereof.

Figure 5:
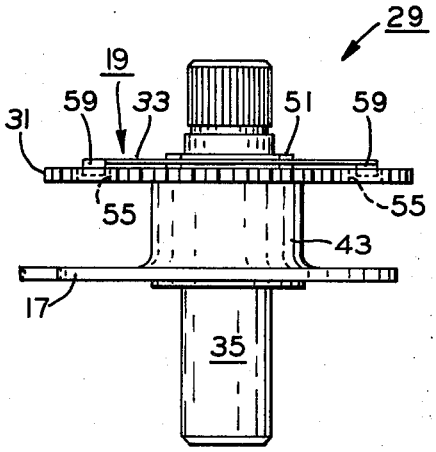
FIGS. 5 and 6 are partial views taken from FIGS. 3 and 4 illustrating an assembly in one form of the invention in the timer device, respectively.
Figure 6:
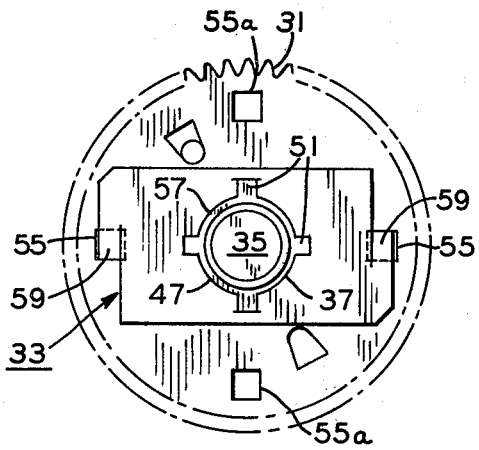

With reference again in general to the drawings and recapitulating at least in part with respect to the foregoing there is indicated at 29 an assembly in one form of the invention for use in timer 11. Assembly 29 has a gear means or driven means, such as a driven gear 31, adapted for driven rotation at the aforementioned preselected speeds different than that of cam 15 and with cam 15 having fall 21 in camming surface 25 thereof (FIGS. 3–5). Another driven means, such as cam 17, is arranged adjacent cam 15 for conjoint rotation with the driven means or gear 31, and the driven means or cam 17 includes rise 23 which is generally inverted with respect to fall 21 in cam 15 (FIGS. 3, 7 and 8). Means, such as a detent spring 33, connected with cam 17 is adjustably movable between a pair of adjusted or operating positions in releasable engagement with gear 31 for transmitting the driven rotation thereof to cam 17 (FIGS. 4–8). Transmitting means or detent spring 33 is adjustably movable in response to a manually applied force thereon into one of its adjusted positions (as best seen in FIG. 8) to predeterminately locate cam 17 arcuately with respect to cam 15 so that rise 23 of cam 17 is rotated into overlaying or switch operation interferring relation with fall 21 in cam 15 in the aforementioned preselected sequence upon the driven rotation of cams 15, 17 with respect to each other at the preselected different speeds thereof (FIGS. 3–8).

More particularly and with specific reference to FIGS. 3 and 5, assembly 29 has a shaft 35 rotatably supported or otherwise mounted in timer 11. Cam 15 is integrally formed with a sleeve 37 having a bore 39 therethrough in which shaft 35 is received, and a gear 41 is also integrally formed on cam 15 so that it may be driven in rotation about the shaft, as discussed in greater detail hereinafter. Although cam 15, sleeve 37 and gear 41 are disclosed as being integrally formed, it is contemplated that such components may be individually formed and secured together by suitable means within the scope of the invention so as to meet the objects thereof. Cam 17 is also integrally formed with a sleeve 43 having a bore 45 therethrough which is secured by suitable means, such as a press-fit for instance, about shaft 35 so that cam 17 is conjointly rotatable with the shaft, and in the assembled positions of cam 15, 17 on shaft 35, it may be noted that the cams are arranged generally in side-by-side relation with each other with sleeves 37, 43 thereof in rotating sliding or abutting engagement, respectively. Although cam 17 and sleeve 43 are illustrated as being integrally formed for purposes of disclosure, it is contemplated that such components could be individually formed and secured together by suitable means within the scope of the invention so as to meet the objects thereof. Sleeve 43 has a free end or end portion 47 which is undercut at 49 thereby to provide a seat for gear 31, and a plurality of flutes or fingers 51 or the like extend from the sleeve free end thereby to provide a means for receiving detent spring 33 against displacement.

Gear 31 is provided with a generally central opening or aperture 53 therethrough which is received about seat 49 therefor on sleeve free end 47 so that the gear is rotatably mounted in both driving and adjusting rotation with respect to sleeve 43 and cam 17, as discussed in greater detail hereinafter. A plurality of pairs or sets of detents 55, 55*a* are provided through gear 31 and arranged in predetermined arcuate spaced relation generally about the gear adjacent the peripheral portion thereof, and numerical indicia is provided generally adjacent the detent pairs for indicating the aforementioned forty-five and ninety minute operating modes of timer 11.

Detent spring 33 may be formed, if desired, from a generally thin resilient sheet material having a generally central opening or aperture 57 therethrough shaped and sized so as to be releasably secured on free end 47 of sleeve 43 in gripping engagement, such as an interference-fit for instance, with sleeve flutes 51. When so releasably secured to sleeve free end 47, detent spring 33 is disposed at least in part with a face of gear 31 so as to retain it against displacement from its seat 49 on the sleeve free end. A pair or set of means, such as opposite abutments or spring fingers 59, are integrally deformed from detent spring 33, or otherwise provided thereon, for resilient engagement with detent pairs 55 in gear 31. Although detent spring 33 is illustrated herein for purposes of disclosure in its particular shape or form, it is contemplated that other detent springs may be utilized within the scope of the invention so as to meet the objects thereof. Thus, it may be noted that the driven rotation of gear 31 is transmitted through detent spring 33 to sleeve 43, cam 17 and shaft 35 so as to effect the conjoint rotation thereof in one direction with gear 31 when detent spring fingers 59 are engaged with detents 55 in the gear. Assuming detent spring fingers 59 are engaged with detent pair 55 defining the forty-five minute setting of timer 11, as previously discussed, the aforementioned manual or adjusting force is applied onto shaft 35 to effect the adjusting rotation thereof in the direction opposite the rotational direction of driven gear 31. This adjusting movement or rotation of shaft 35 effects the conjoint rotation therewith of cam 17, its sleeve 43 and detent spring so as to rotate detent spring fingers out of driving engagement with detent pair 55 defining the forty-five minute setting of timer 11 and into driving engagement with the next successive or other detent pair 55*a* defining the ninety minute setting of the timer. Thus, it may be noted that upon the adjusting movement of detent spring 33 so as to engage its fingers 59 with the detent pair 55*a*, the adjusted or operating positions of cam 17 is also changed with respect to cam 15 thereby to alter the preselected sequences in which switch 13 is actuated by fall 21 in cam 15, as previously discussed.

With further reference in general to the drawings and recapitulating at least in part with respect to the foregoing, timer 11 in one form of the invention has at least one switch, such as switch 13 for instance, and at least one cam means, such as cam 15 for instance, adapted for driven rotation so as to actuate switch 13 in the first preselected sequence (FIGS. 1, 4 and 7). Means, such as for instance a drive or drive train indicated generally at 61, is provided for driving cam 15 to effect the rotation thereof (FIG. 1). Means, such as assembly 29, for driven association with driving means or drive 61 includes means, such as for instance cam 17, rotatably adjustable with respect to cam 15 from one operating position of at least a pair of operating positions toward another thereof for interrupting the actuation of switch 13 by cam 15 in the first preselected sequences and for affecting the actuation of the switch by cam 15 in another preselected sequence (FIGS. 1, 4 and 8).

More particularly and with specific reference to FIGS. 1 and 3, timer 11 has a housing 63 with a plurality of wall means 65 defining therein a chamber 67, and a pair of opposite ends or end portions 69, 71 of shaft 35 are rotatably supported or otherwise mounted in a pair of opposite wall means 73,75 of the wall means plurality 65 with shaft end 71 extending exteriorly of housing wall means 75 so that the aforementioned adjusting force may be conveniently applied thereto.

Drive 61 includes a synchronous motor 77, such as a model 51 available from the Timex Clock Company, Ashland, Massachusetts, which is attached to wall 73 of housing 63 exteriorly thereof by suitable means, such as a plurality of posts and screws 79 for instance, and albeit not shown, an output shaft of the motor extends through housing wall 73 into driving engagement with a gear train 81 of drive 61 supported or otherwise arranged in chamber 67 between housing walls 73, 75. Gear train 81 has a branch or section 83 drivingly coupled or otherwise meshed with gear 41 of cam 15 thereby to drive the cam at a preselected rotational speed about shaft 35, and another or reducing branch or section 85 of the gear train is drivingly coupled or otherwise meshed with gear 31 of assembly 29 so as to drive it at a reduced speed predeterminately less than that at which gear train branch 83 drives cam 15.

As best seen in FIG. 4, an end wall 87 of timer housing 63 may be formed of suitable dielectric material and is secured by suitable means, such as crimping for instance, between at least opposite walls 73, 75 of the housing. A plurality of terminals 89 are secured to housing end wall 87 by suitable means, such as riveting, staking or the like for instance (not shown), and the terminals have electrical connector sections exteriorly of housing 63 and switch means supporting sections within housing chamber 67.

Switch 13 comprises a pair of current carrying blades 91, 93 having a pair of contacts 95, 97 thereon, respectively, and the blades are mechanically and electrically connected with the supporting sections of adjacent terminals 89 within housing chamber 67. Switch blade 91 has a distal or free end or cam follower portion 99 arranged in following engagement with camming surface 25 of cam 15 and adapted to engage camming surface 27 of cam 17. Although switch 13 of the slow make and break type is illustrated herein for purposes of disclosure, it is contemplated that other switches having other configurations and of other functioning types may be utilized within the scope of the invention so as to meet the objects thereof.

Figure 2:
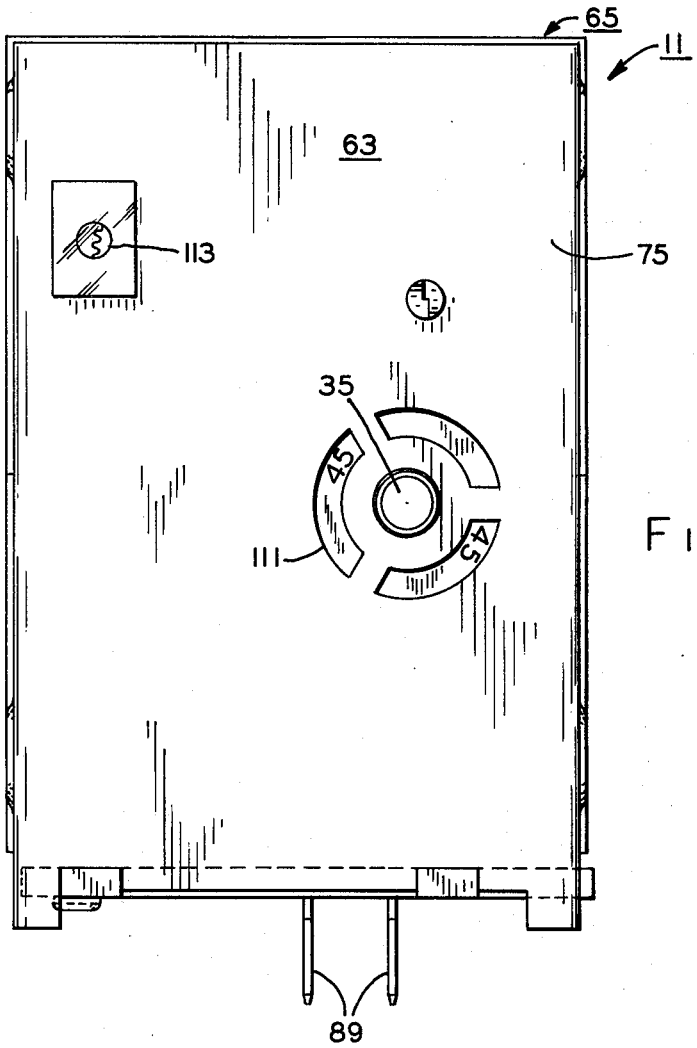
FIG. 2 is a right side elevational view of the timer device of FIG. 1.

If desired, another cam means or cam 101 having a sleeve 103 keyed or otherwise coupled at 105 with sleeve 37 of cam 15 may be arranged on shaft 35 so as to be conjointly rotatable with cam 15, and another switch means or switch 107 having generally the same components as switch 13 may be actuated by the rotation of cam 101 and similarly mounted to the supporting sections of other adjacent terminal 89 in housing end wall 87. Albeit not shown, cam 101 may have a configuration, i.e. a peripheral or camming surface with a fall therein for effecting the actuation of switch 107, which is the same as that previously discussed with respect to cam 15, so that upon conjoint rotation of cams 15, 101, switches 13, 107 are each operated in a preselected or predetermined sequence; however, it is contemplated that cams 15, 101 may have different configurations so as to actuate switches 13, 107 in different preselected sequences within the scope of the invention so as to meet the objects and advantageous features thereof. To complete the description of timer 11, at least one opening 111 is provided through housing wall 75 generally adjacent shaft 35 to display the minute setting indicia on driven cam 31 which indicates the particular operating mode of the timer, as previously discussed and as shown in FIG. 2, and a window 113 or the like may also be provided through wall 75 so that an operator may ascertain whether or not the timer is operating.

OPERATION

In the operation, assume that timer 11 is set in its forty-five minute operating mode and that motor 77 is energized so as to drive gear train 81 to effect the driven rotation of cam 15 at one preselected speed and also to drive gear train branch 83 to effect the driven rotation of cam 17 through assembly 29 at another preselected speed predeterminately less than that of cam 15. With spring fingers 59 of detent spring 33 arranged in driven engagement with detent pair 55 which defines the forty-five minute operating mode of timer 11, cam 17 is disposed in its one operating or adjusted position with respect to cam 15 so that rise 23 of cam 17 is never located or rotated into overlaying or blocking relation with fall 21 in cam 15 when switch 13 is being actuated by the fall, as best seen in FIG. 7. Of course, when follower end 99 of switch blade 91 is biased toward following engagement with cam surface 25 of cam 15, contacts 95, 97 of switch 13 are broken thus interrupting a circuit through timer 11 generally comprising switch blades 91, 93, the contacts thereof and the respective ones of terminals 89 with which the blades are connected, respectively. During each revolution of cam 15, fall 21 is rotated beneath follower end 99 of switch blade 91 causing the switch blade to resile toward switch blade 93 to engage or make contacts 95, 97 and complete the aforementioned circuit through the timer during a preselected time period which is, of course, dependent upon the arcuate length of the fall and the rotational speed at which cam 15 is driven. After fall 21 is rotated past follower end 91 of switch blade 91, camming surface 25 of cam 15 again engages the follower end so as to move the switch blade to its break position disengaging contact 95 thereon from contact 97 on switch blade 93 thereby to again break or interrupt the aforementioned circuit through timer 11. In this manner, switch 13 is actuated between the conductive modes thereof by cam 15 during each successive revolution of the cam, i.e. in the preselected sequence illustrated schematically in FIG. 7.

In the event an operator wishes to increase the defrost time interval of timer 11, the operator exerts an applied force on exterior end 71 of shaft 35 thereby to conjointly rotate the shaft, cam 17 and its sleeve 43, and detent spring 33 with respect to cam 15 and gear 31, respectively. Upon such adjusting rotation, spring fingers 59 of detent spring 33 are rotated therewith from their position in driven engagement with detents 55 into an adjusted position in driven engagement with detents 55*a* which define the ninety minute operating mode of timer 11. Concurrently therewith, cam 17 is also rotatably moved or adjusted to its other adjusted position with respect to cam 15, as illustrated schematically in FIG. 8. With cam 17 so disposed in its other adjusted position, rise 23 thereof is rotated into overlaying or blocking relation with fall 21 upon every other revolution of cam 15. Thus, when rise 23 of cam 17 is arranged generally in the overlaying relation with fall 21 of cam 15, camming surface 27 of cam 17 is engaged with follower end 99 of switch blade 91 thereby to obviate or prevent the entry of the switch blade follower end 99 into the fall and the resiling movement of the switch blade to close contacts 95, 97. In this manner, cam 17 prevents the actuation of switch 13 between its conductive modes during every other revolution of cam 15 and effects the actuation of the switch by cam 15 in the another different preselected sequence, as illustrated schematically in FIG. 8.

Of course, irrespective of the operating mode in which timer 11 may be set, cam 101 is conjointly rotatably driven with cam 15 about shaft 35 since cams 15, 101 are keyed together at 105; therefore, rotation of cam 101 effects the actuation of switch 107 between its conductive modes generally in the same manner and in the same preselected sequence as the above discussed actuation of switch 13 by cam 15.

In view of the foregoing, it is believed that a novel timer device 11, a novel assembly 15 and a novel method of operating a timer device have been presented meeting the objects set out hereinbefore, and it is contemplated that changes as to the precise arrangements, shapes, details and connections of the component parts utilized in such timer device, assembly and method, as well as the method steps and precise order thereof, may be made by those having ordinary skill in the art without departing from the spirit of the invention or the scope thereof as set out by the claims which follow.

What I claim as new and desire to secure by Letters Patent of the United States:

1. A timer device comprising:

a housing having a plurality of wall means defining at least in part a chamber within said housing;

a shaft having a pair of opposite end portions rotatably supported in a pair of opposite wall means of said wall means plurality with at least one of said opposite end portions extending through one of said opposite wall means exteriorly of said housing;

a first cam mounted on said shaft so as to be rotatable thereabout and including a first peripheral cam surface, and a fall in said first cam surface extending a preselected arcuate distance thereon;

a first driven gear associated with said first cam so as to be conjointly rotatable therewith about said shaft;

switch means mounted within said chamber to another wall means of said wall means plurality and adapted for operation between at least a pair of switching modes, said switch means including a follower portion associated in following engagement with said first cam surface of said first cam without said fall thereof in one of the switching modes of said switch means;

a sleeve having a bore therein received on said shaft so as to be conjointly rotatable therewith;

a second cam on said sleeve so as to be conjointly rotatable therewith and with said shaft and arranged generally in side-by-side relation with said first cam, said second cam including a rise extending a preselected arcuate distance thereon generally about the same as that of said fall in said first cam and with said rise having a second peripheral cam surface at least generally radially coextensive with said first cam surface of said first cam;

a second driven gear rotatably received on said sleeve and including a plurality of pairs of spaced apart detents;

a gear train within said chamber associated with said first and second driven gears and operable generally for rotatably driving them at preselected different speeds, respectively;

an electric motor associated with said housing and adapted for energization to effect the operation of said gear train; and detent spring means secured to said sleeve so as to be conjointly rotatable therewith and arranged for releasable engagement with respective ones of said detent pairs of said second driven gear, respectively, said rise on said second cam being arcuately displaced with respect to said fall in said first cam so that said switch means is actuated to another of its switching modes in a preselected sequence as said fall in said first cam passes beneath said follower portion of said switch means during each revolution of said first cam upon the conjoint driven rotation of said first and second cams at the different preselected speeds thereof when said detent spring means is releasably engaged with one of said detent pairs in said second driven gear, and said detent spring means being adjustably movable from said one detent pair into releasable engagement with another of said detent pairs in said second driven gear in response to a manually applied force on said at least one opposite end portion of said shaft so as to adjustably reposition said rise of said second cam with respect to said fall in said first cam wherein said second cam surface on said rise engages said follower portion of said switch means generally as said fall in said first cam passes therebeneath thereby to prevent the actuation of said switch means to its another switching mode in the same preselected sequence during at least a preselected one of the revolutions of said first cam upon the conjoint driven rotation of said first and second cams at the different preselected speeds thereof, respectively.

2. A timer device comprising:

a pair of switch means adapted for operation between at least a pair of switching modes, respectively;

a pair of cam means arranged for conjoint rotation with each other and including a pair of means arranged in predetermined arcuately spaced relation and operable generally for actuating said switch means between the at least switching mode pair thereof during at least a part of a revolution of said cam means upon the conjoint rotation thereof, respectively;

means for driving said cam means to effect the conjoint rotation thereof;

a third cam means arranged generally adjacent one of said cam means and adapted for rotation therewith and also for rotation with respect thereto;

means associated with said driving means and said third cam means for effecting the rotation of said third cam means with said one cam means and including means for adjustably rotating said third cam means between at least a pair of adjusted positions with respect to said one cam means; and means on said third cam means and operable generally for obviating the operation of one of said switch means between its at least switching mode pair by one of said actuating means during at least a part of a preselected revolution of said one cam means when said adjustably rotating means is in one adjusted position of the at least pair thereof.

3. A timer device as set forth in claim 2 wherein said driving means effects the rotation of said cam means pair and said third cam means at different preselected rotational speeds, respectively.

4. A timer device as set forth in claim 2 wherein said actuating means comprise at least one switch means operation configuration on said cam means pair, respectively.

5. A timer device as set forth in claim 4 wherein said obviating means comprises a third switch means operation configuration on said third cam means generally inverted with respect to said at least one configuration of said one cam means and arranged generally in masking relation with said at least one configuration of said one cam means so as to prevent the actuation of said one switch means during the at least part of the preselected revolution by said one cam means when said adjustably rotating means is in the one adjusted position thereof.

6. A timer device as set forth in claim 2 wherein said rotation effecting means includes a rotatable shaft, said third cam means being fixedly received on said shaft so as to be conjointly rotatable therewith, and a driven gear rotatably received about at least said shaft and coupled with said third cam means by said adjustably rotating means in its adjusted positions.

7. A timer device as set forth in claim 6 wherein said driven gear includes a plurality of detents therein, and said adjustably rotating means comprises a detent spring associated with said third cam means and arranged in releasable engagement with at least one of said detents so as to effect the conjoint rotation of said third cam means and said shaft in response to the rotation of said driven gear, and said detent spring, said third cam means and said shaft also being conjointly rotatable with respect to said driven gear in response to a manually applied force on said shaft so as to rotate said detent spring to the one adjusted position into releasable engagement with at least another of said detent and so as to locate said obviating means on said third cam means with respect to said one cam means to prevent the actuation of said one switch means.

8. A timer device comprising:

switch means adapted for operation between at least a pair of switching modes;

cam means associated with said switch means and generally rotatable for actuating said switch means between the at least switching mode pair thereof in a preselected sequence;

means for driving said cam means to effect the rotation thereof; and gear means for driven association with said driving means and including means adjustably rotatable to one of a plurality of predetermined operating positions with respect to said cam means for interrupting the actuation by said cam means of said switch means in the preselected sequence and for permitting the actuation of said switch means by said cam means in another preselected sequence different than the first named preselected sequence.

9. A timer device as set forth in claim 8 wherein said cam means and said gear means are arranged so as to be rotated at different preselected speeds by said driving means.

10. A timer device as set forth in claim 8 wherein said interrupting and permitting means comprises a cam arranged generally adjacent said cam means, and a portion predeterminately arranged on said cam so as to be rotatable therewith into a position with respect to said cam means so as to engage said switch means and block the actuation of said switch means in the preselected sequence by said cam means when said interrupting and permitting means is in its one predetermined operating position.

11. A timer device as set forth in claim 8 wherein said cam means includes at least one fall therein to effect the actuation of said switch means between the at least switching mode pair thereof.

12. A timer device as set forth in claim 11 wherein said interrupting and permitting means includes a rise rotatable with respect to said cam means generally into adjacent overlaying relation with said at least one fall so as to block the actuation thereby of said switch means in the first named preselected sequence.

13. A timer device as set forth in claim 8 wherein said gear means further includes a driven gear associated with said driving means, and means releasably engaged with said driven gear and connected with said interrupting and permitting means for adjustably moving it to the one predetermined operating position thereof.

14. A timer device as set forth in claim 13 wherein said driven gear includes a plurality of detents and said adjustably moving means includes a detent spring releasably engaged with at least one of said detents, said detent spring being manually movable from said at least one detent into releasable engagement with at least another of said detents so as to locate said interrupting and permitting means in the one predetermined operating position thereof with respect to said cam means.

15. A timer device as set forth in claim 8 wherein said gear means further includes a rotatable shaft, said interrupting and permitting means comprising a cam fixedly received on said shaft so as to be conjointly rotatable therewith, a driven gear associated with said driving means and rotatably received about at least said shaft, a plurality of detents in said driven gear, a detent spring coupled with said cam and arranged in releasable engagement with at least one of said detents so as to effect the conjoint rotation of said cam and said shaft in response to the rotation of said driven gear, and said detent spring, said cam and said shaft being conjointly rotatable with respect to said driven gear in response to a manually applied force on said shaft so as to rotate said detent spring into releasable engagement with at least another of said detents thereby to locate said cam in its one predetermined operating position with respect to said cam means.

16. A timer device comprising a switch, a rotatable cam means for actuating said switch in a preselected sequence, means for driving said cam means at a preselected speed, means for driven association at a different preselected speed with said driving means and including means adjustable between at least a pair of operating positions and rotatable in at least one of the positions with respect to said cam means for interrupting the actuation of said switch in the preselected sequence and for effecting the actuation of said switch in another different preselected sequence.

17. An assembly adapted for use in a timer device comprising:

a rotatable shaft;

cam means secured to said shaft for conjoint rotation therewith and including at least one switch means operating configuration;

a driven gear rotatably received about at least said shaft and including a plurality of detents; and a detent spring coupled with said cam means and arranged in releasable driven engagement with at least one of said detents so as to effect the conjoint rotation of said cam means and said shaft with said driven gear upon the rotation thereof, and said detent spring, said cam means and said shaft being conjointly adjustable with respect to said driven gear in response to a manually applied rotative force on said shaft so as to rotate said detent spring into releasable engagement with at least another one of said detents thereby to adjustably relocate said at least one switch means operating configuration on said cam means.

18. An assembly for use in a timer device comprising:

a pair of means respectively adapted for driven rotation and with one of said driven rotation means having at least one switch means operating configuration thereon;

means mounted on one of said one driven rotation means and the other of said driven rotation means so as to be conjointly rotatable therewith and adjustably movable between a plurality of adjusted positions in releasable engagement with the other of said one driven rotation means and said other driven rotation means for transmitting the rotation thereof to said one of said one driven rotation means and said other driven rotation means, and said transmitting means being adjustably movable in response to a manual rotative force applied to said one driven rotation means from one of the adjusted positions toward another thereof so as to predeterminately relocate said at least one switch means operating configuration of said one driven rotation means with respect to said other driven rotation means.

19. A method of operating a timer device having switch means adapted for operation between at least a pair of switching modes, and a pair of cam means for actuating the switch means, respectively, the method comprising the steps of:

(a) rotating the cam means at different preselected speeds through at least a part of one revolution thereof, respectively, so as to effect the actuation of the switch means by one of the cam means in a preselected sequence;

(b) changing the preselected sequence by manually adjusting to one adjusted position of at least a pair thereof a means on the other of the cam means for obviating the actuation of the switch means by the one means during the at least part of the one revolution thereof and effecting the actuation of the switch means by the one cam means during a successive revolution thereof while continuing the rotation of the cam means at the different preselected speeds.

20. A method of operating a timer device having at least one switch means adapted for operation between at least a pair of switching modes, and at least one cam means for actuating the at least one switch means between the at least switching mode pair thereof, the method comprising the steps of:

rotating the at least one cam means at a preselected speed so as to effect the actuation of the at least one switch means between the at least switching mode pair thereof in a preselected sequence; and adjusting with respect to the at least one cam means and from one operating position of at least a pair of operating positions toward another operating position thereof a means for interrupting the actuation of the at least one switch means by the at least one cam means in the preselected sequence and for permitting the actuation of the at least one switch means by the at least one cam means in another preselected sequence different than the first named preselected sequence and rotating the interrupting and permitting means at another preselected speed different than the first named preselected speed of the at least one cam means.

* * * * *